United States Patent [19]

Berta

[11] 4,358,867

[45] Nov. 16, 1982

[54] SHOE CLEANING DEVICE

[76] Inventor: Sophia Berta, 224 Queensland Dr., SE., Calgary, Alberta, Canada, T2J 3R8

[21] Appl. No.: 235,698

[22] Filed: Feb. 17, 1981

[30] Foreign Application Priority Data

Nov. 17, 1980 [CA] Canada ..... 364781

[51] Int. Cl.[3] ..... A47L 23/22

[52] U.S. Cl. ..... 15/36

[58] Field of Search ..... 15/21 D, 34, 36, 38, 15/48, 97 A, 104.92

[56] References Cited

U.S. PATENT DOCUMENTS 2,958,883 11/1960 Walters ..... 15/97 A
3,641,609 2/1972 Hansen ..... 15/36 X
4,280,244 7/1981 Spirig ..... 15/36 X

FOREIGN PATENT DOCUMENTS 734137 5/1966 Canada ..... 15/36
700102 11/1979 U.S.S.R. ..... 15/36

*Primary Examiner*—Edward L. Roberts
*Attorney, Agent, or Firm*—George H. Dunsmuir

[57] ABSTRACT

A shoe cleaning device primarily intended for domestic use includes an elongated casing with an open top end; a pair of parallel rollers rotatably mounted in the casing; pads carried by the rollers, the pad on one roller having a deep pile for picking up cleaning water and for removing dirt from the bottom of a shoe sole when the sole is rubbed against the roller, the second roller constantly engaging the first roller and having a shorter, brush-like pile for removing dirt from the first roller. The first roller is slidably mounted in the casing for movement between a rest position and an operating position, in which the roller moves downwardly against the bias of springs into contact with the cleaning water. The springs return the first roller to the rest position at the end of a cleaning operation.

4 Claims, 3 Drawing Figures

SHOE CLEANING DEVICE

BACKGROUND OF THE INVENTION

This invention relates to a footwear cleaning device, and in particular to a cleaning device, which is primarily intended for domestic use, and which cleans the bottom of shoe soles.

Existing shoe cleaning devices of the above mentioned type range from the extremely simple, i.e., the common door mat to the complicated, i.e., mechanical devices of the type disclosed by U.S. Pat. Nos. 2,463,153, issued to E. F. Conklin on Mar. 1, 1949; and 3,445,875, issued to I. M. Bohannon on May 27, 1969. The problem with the common door mat is that it often leaves dirt on the footwear sole. The more complicated machines, while cleaning soles more efficiently, are somewhat expensive.

There exists a need for a shoe cleaning device, which can readily be mass produced, and which can be sold at a price acceptable to the average urban dweller.

The object of the present invention is to provide a shoe cleaning device which is relatively simple and relatively inexpensive.

SUMMARY OF THE INVENTION

Accordingly, the present invention relates to a device for cleaning a footwear sole comprising a casing; first roller means rotatably mounted in said casing; first pad means on said roller means for cleaning a footwear sole when the sole is pressed against said first pad means and reciprocated in a direction perpendicular to the direction of rotation of said first roller means; second roller means rotatably mounted in said casing; second pad means on said second roller means in substantially constant engagement with said first pad means for cleaning said first pad means when said first and second roller means are rotated.

BRIEF DESCRIPTION OF THE DRAWINGS

The invention will now be described with reference to the accompanying drawings, which illustrate a preferred embodiment of the invention, and wherein.

DESCRIPTION OF THE PREFERRED EMBODIMENT(S)

With reference to the drawings, a shoe cleaning device in accordance with the present invention includes a casing generally indicated at 1. The casing 1 is defined by a rectangular base plate 2, side walls 3, which are approximately one-half the length of the base plate 2, and an end wall 4 integral with and extending between the rear ends of the side walls 3.

Figure 3:
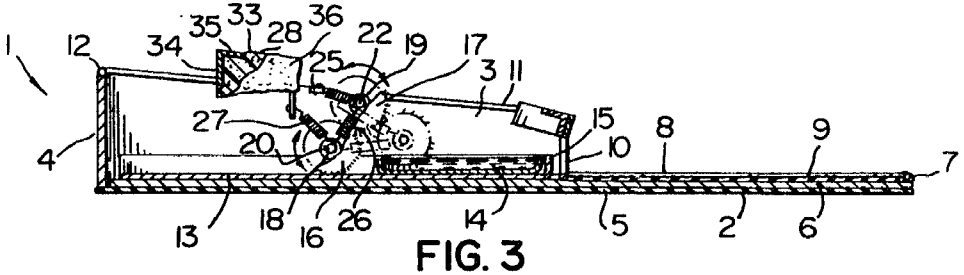
FIG. 3 is a cross-sectional view taken generally along line III—III of FIG. 2, with parts omitted.

As best seen in FIG. 3, the base plate 2 includes a bottom, traction/wear layer 5 which is a sheet of rubber or soft plastic, i.e., polyvinyl chloride. The layer 5 prevents movement of the shoe cleaning device during use, even if the device is on a smooth surface such as a tile or hardwood floor. The layer 5 also protects the floor from the mainly metal casing 1. The layer 5 is attached to a metal plate 6, which is connected to the side and end walls 3 and 4, respectively. The leading end and sides of the plate 6 are provided with upwardly extending beaded edges 7 and 8, respectively, which define walls around a top mat 9. The mat 9 is also formed of rubber or soft plastic. The leading ends 10 and top edges 11 of the side walls 3, and the top edge 12 of the end wall 4 are beaded to improve the appearance of the device and to cover any otherwise sharp edges.

The rear portion of the casing 1, i.e., the portion of the casing 1 between the side walls 3 carries two trays 13 and 14. The larger, bottom tray 13 is substantially co-extensive with such rear portion of the casing 1. The tray 13 includes a bottom wall, side walls and a front wall 15. The tray 13 is open at the rear end for cleaning. The tray 14 is smaller than the bottom tray 13 and sits near the front end of such tray 13. In use, the tray 14 carries water for cleaning the soles of footwear, and the tray 13 is intended to receive dirt and used cleaning water.

As will be readily apparent hereinafter, in this description, the front of the casing is that portion of the casing approached by the user.

Figure 1:
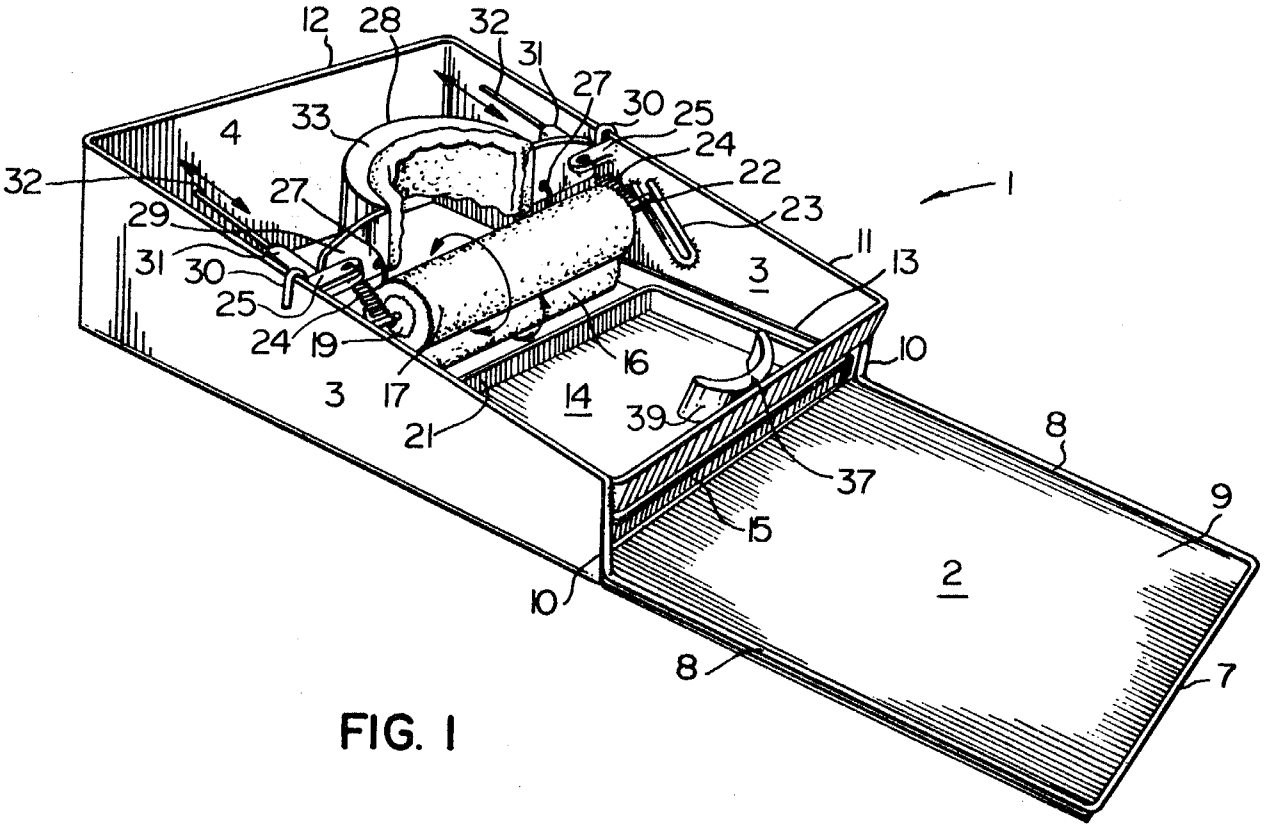
FIG. 1 is a perspective view from above and one end of a shoe cleaning device in accordance with the present invention.
Figure 2:
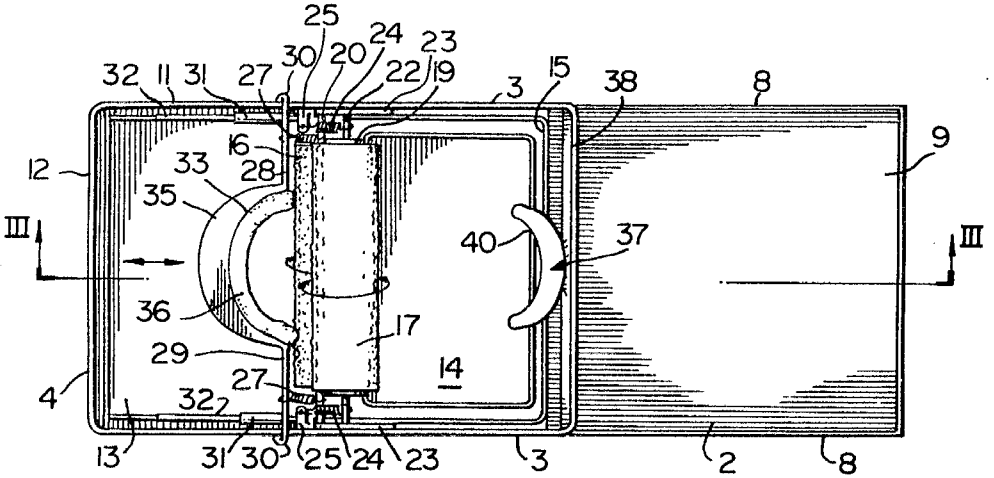
FIG. 2 is a plan view of the device of FIG. 1.

The bottom of the sole of a shoe or boot is clean by means of cylindrical pads 16 and 17 mounted on rollers 18 and 19. The roller 18 is mounted on a shaft 20 (FIGS. 2 and 3), which is rotatably mounted in side walls 3 of the casing 1 behind rear edge 21 (FIG. 1) of the tray 14. Shaft 22 of the roller 19 is mounted above and forwardly of the shaft 20 in elongated guides 23 on the side walls 3 of the casing 1. The guides 23 are merely U-shaped metal rods welded to the inner surfaces of the side walls 3 and defining downwardly and forwardly inclined tracks for the shaft 22. The bottom ends of the guides 23 are closed for limiting movement of the pad 17 and the roller 19. Helical springs 24 extend between the ends of the shaft 22 and lugs 25 projecting outwardly from the top of the side walls 3 rearwardly of the pad 17. A second pair of springs 26 extend between the ends of the shaft 22 and the ends of the shaft 20, thus maintaining pads 16 and 17 in contact one with the other while sole is being cleaned. The springs 24 and 25 normally maintain the roller 19 in the uppermost position, and return the roller 19 to such position at the end of a shoe cleaning operation. A third pair of springs 27 extend between the shaft 20 of roller 18 and a toe engaging crossbar 28.

The crossbar 28 is slidably mounted in the casing for rearward movement between the side walls 3. The springs 27 limit such rearward movement, and return the crossbar 28 to the rest position shown in the drawings. The crossbar 28 is in the form of a vertically oriented central plate portion 29 with inverted U-shaped rods 30 at each end thereof for slidably mounting the crossbar on the side walls 3. Rearwardly extending sleeves 31 (FIGS. 1 and 2) are provided near each end of the crossbar 28 between the side walls 3 for slidably mounting the crossbar on rods 32. The rods 32 are connected to and extend rearwardly and slightly upwardly from the lugs 25.

Referring to FIG. 3, the centre of the crossbar 28 is generally semi-circular, defining a toe engaging section 33. The toe engaging section 33 of the crossbar includes an arcuate vertical rear wall 34, a flange 35 extending along the top edge of such rear wall, and a sponge rubber pad 36 on the front of the rear wall 34 and the flange 35. The device is completed by an arcuate heel retainer 37, which is mounted on a crossbar 38 extending between the front ends of the side walls 3. The heel retainer 37 includes an arcuate inclined plate 39 connected to the crossbar 38 and a cresent-shaped flange 40 extending rearwardly from the top edge of the plate 39.

The shoe cleaning device is placed on a porch or in a vestibule or front hall, i.e., just outside or inside of a door of a dwelling. In use, a person steps onto the mat 9. The front end of one shoe is inserted into the gap between the pad 36 and the top pad 17. By exerting downward pressure on the pad 17, the roller 19 and the pad 17 are caused to move downwardly and forwardly from the rest position to the operation position shown in phantom outline in FIG. 3. In operation pad 17 normally remains in contact with the pad 16, except when sufficient pressure is applied to pad 17 to enable pad 17 to pick up water from the tray 14. By moving the foot back and forth slightly, i.e., with the toe always at least slightly under the pad 36, dirt is removed from the sole of the shoe. The dirt is transferred to the pad 16 on roller 18, and drops from the pad 16 into the tray 13 rearwardly of the tray 14. For such purposes, the top roller 19 is provided with a soft, deep pile pad 17, and the bottom roller 18 is provided with a short bristle or brush-like pad 16. The pad 16 can be a short pile paint roller and the pad 17 a long pile paint roller.

While the rollers 18 and 19 have been illustrated as being rotatable in both directions, it will be appreciated that the device would probably be more efficient if the roller 19 and the pad 17 were free to rotate in one direction only. Thus, any dirt transferred from the sole to the pad 17 would not be returned to the sole because of reciprocating movement of the pad 17. In order to ensure rotation of the roller 19 in one direction only, a ratchet wheel (not shown) can be provided on one or both ends of the shaft 22 for engagement by a pawl (not shown) on the side wall 3 when the shoe is moved rearwardly. Thus, forward movement of the foot towards the rear wall 4 of the casing 1 would cause the pad 17 and roller 19 to rotate. During rearward movement of the foot, the pawl and ratchet wheel would lock the roller 19 in one position, and the sole of the shoe would merely slide over the pad 17.

Upon completion of a shoe cleaning operation, the heel of the shoe is hooked under the flange 40 of the heel retainer 38, which facilitates removal of the shoe, i.e., the shoe can be removed from the foot of the wearer merely by pulling the foot out of the shoe. The shoe remains in the shoe cleaning device with the toe end sandwiched between pads 17 and 36.

Thus, there has been described a relatively simple device for cleaning a sole of an article of footwear. In its simplest form, the device of the present invention includes the casing and the two rollers only, one roller removing dirt from a footwear sole and the second roller removing dirt from the first roller. Of course, the use of water for more thorough cleaning is preferred.

Further modifications and alternative embodiments of the invention will be apparent to those skilled in the art in view of the foregoing description. Accordingly, this description is to be construed as illustrative only and is for the purpose of teaching those skilled in the art, the manner of carrying out the invention. It is further understood that the form of the invention herewith shown and described is to be taken as the presently preferred embodiment. Various changes may be made in the shape, size and general arrangement of components, for example, equivalent elements may be substituted for those illustrated and described herein, parts may be used independently of the use of other features, all as will be apparent to one skilled in the art after having the benefits of the description of the invention.

What I claim is:

1. A device for cleaning a footwear sole comprising a casing; first roller means rotatably mounted in said casing; first pad means on said roller means for cleaning a footwear sole when the sole is pressed against said first pad means and reciprocated in a direction perpendicular to the direction of rotation of said first roller means; second roller means rotatably mounted in said casing; second pad means on said second roller means in substantially constant engagement with said first pad means for cleaning said first pad means when said first and second roller means are rotated; tray means in said casing for holding a sole cleaning liquid; and guide means in said casing permitting movement of said first roller means from a rest position to an operating position in which said first pad means contacts said cleaning liquid, whereby rotation of said first roller means effects transfer of the cleaning liquid to the sole; spring means for normally resiliently retaining said first roller means in said rest position and for returning said first roller means to said rest position upon completion of a sole cleaning operation.

2. A cleaning device according to claim 1, including footwear engaging means for retaining said footwear in contact with said first roller means during a footwear cleaning operation.

3. A cleaning device according to claim 2, wherein said footwear engaging retaining means includes a crossbar slidably mounted on said casing in substantially parallel relationship to said first and second pad means; and return spring means for biasing said crossbar towards said first pad means, whereby, when an article of footwear is placed between the crossbar and first pad means, the article of footwear is pressed against the first pad means.

4. A cleaning device according to claim 1, including heel retaining means for engaging the heel of a footwear sole, whereby the footwear can be removed from a foot of a wearer and remain in the cleaning device.

* * * * *